US006276341B1

(12) United States Patent
Takahashi et al.

(10) Patent No.: US 6,276,341 B1
(45) Date of Patent: Aug. 21, 2001

(54) INTERNAL-COMBUSTION ENGINE CONTROL SYSTEM

(75) Inventors: Tatsuhiko Takahashi; Takeshi Kawakami, both of Hyogo; Atsuko Hashimoto, Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/435,024

(22) Filed: Nov. 5, 1999

(30) Foreign Application Priority Data

Jan. 26, 1999 (JP) ..... 11-017635
Jun. 29, 1999 (JP) ..... 11-183687

(51) Int. Cl.[7] ..... F02D 41/10
(52) U.S. Cl. ..... 123/492; 123/478
(58) Field of Search ..... 123/478, 480, 123/492, 493; 701/103, 104, 105

(56) References Cited

U.S. PATENT DOCUMENTS 4,479,186 * 10/1984 Takao et al. ..... 701/104
4,967,711 * 11/1990 Morikawa ..... 123/478
6,082,334 * 7/2000 Shomura et al. ..... 123/478

FOREIGN PATENT DOCUMENTS 9-287496 11/1997 (JP) .

* cited by examiner

*Primary Examiner*—Willis R. Wolfe
(74) *Attorney, Agent, or Firm*—Sughrue, Mion, Zinn, Macpeak & Seas, PLLC

(57) ABSTRACT

An internal-combustion engine control system is able to suppress the occurrence of problems such as changes in air-fuel ratio. The internal-combustion engine control system is equipped with intake pressure detecting means for detecting intake pressure in the internal-combustion engine; operating state detecting means for detecting the operating state of the internal-combustion engine; and controlling means for controlling the operation of the internal-combustion engine according to the operating state of the internal-combustion engine; wherein the controlling means corrects the amount of the fuel injection according to a differential pressure between the intake pressure in a steady operation mode of the internal-combustion engine and an intake pressure detected by the intake pressure detecting means.

10 Claims, 9 Drawing Sheets

INTERNAL-COMBUSTION ENGINE CONTROL SYSTEM

BACKGROUND OF THE INVENTION

1. Field of the Invention

The present invention relates to a D-jetronic control system that calculates a fuel injection amount based on intake pressure of an internal-combustion engine, and more particularly, to correcting a fuel injection amount in response to a change in intake pressure caused by inertia charge.

2. Description of the Related Art

A typical conventional internal-combustion engine control system (hereinafter referred to as an engine control system or ECU) determines the amount of fuel injected according to the engine speed of the internal-combustion engine and intake pressure. The ECU generally determines the fuel injection amount by referring to a two-dimensional map stored and retained in an internal read-only memory (ROM). The two-dimensional map provides correction coefficients of fuel injection amounts that are determined based on the engine speed and differential pressure.

FIG. 10 schematically illustrates the configuration of a conventional internal-combustion engine control system disclosed in Japanese Unexamined Patent Application Laid-open No. 9-287496.

As shown in FIG. 10, the engine is provided with an air cleaner 1, an intake manifold 2, a throttle valve 3, a throttle valve opening sensor 4, an intake pressure sensor 5, an injector 6, a spark plug 7, an exhaust manifold 8, a catalyst 9, an $O_2$ sensor 10, a crankshaft 11, a crank angle sensor 12, a cam angle sensor 14, an exhaust cam pulley 15, an ECU 16, and a variable valve timing device actuator 17.

In the internal-combustion engine shown in FIG. 10, the ECU 16 determines the fuel injection amount based on engine speed, intake pressure, and amount of control of the variable valve timing device.

To be more specific, the ECU 16 determines the amount of fuel to be injected through the injector 6 according to the intake pressure detected by the intake pressure sensor 5, the engine speed detected by the crank angle sensor 12, a target value of valve timing advance (hereinafter referred to as "target advance") detected by phase difference between output signals of the crank angle sensor 12 and the cam angle sensor 14, and the control amount of the variable valve timing device 17.

During an intake stroke of the internal-combustion engine, a spark produced by the spark plug ignites the fuel-air mixture taken into a cylinder. The explosive power pushes a piston 21 down, and the torque of the crankshaft 11 is taken out of the internal-combustion engine.

At this time, the ECU 16 carries out feedback control according to the amount of remaining oxygen in the exhaust gas detected by the $O_2$ sensor 10 so as to provide a stoichiometric ratio that permits the highest efficiency of exhaust gas purification in the catalyst 9.

Moreover, the ECU 16 also controls the control amount of the variable valve timing device 17 so that the target advance stored in the ROM agrees with the actual advance in valve timing (hereinafter referred to as "actual advance") detected by the crank angle sensor 12 and the cam angle sensor 14.

Generally, in an internal-combustion engine, under a condition wherein acceleration or deceleration is being performed at a given opening of a throttle valve (hereinafter referred to as a "transitional operation mode"), there are cases wherein the effect of inertia charge is more conspicuous than in a steady operation mode.

The inertia charge refers to a state wherein inertia of the flow of an intake air introduced into an engine causes more intake air to be pushed into the engine than in the steady operation mode even if the opening of the throttle valve remains constant.

More specifically, even if the opening of the throttle valve 3 remains constant, more intake air is pushed into the engine in the inertia charge mode than in the steady operation mode. For this reason, the intake pressure in the inertia charge mode is seemingly lower.

Therefore, the intake pressure in the transitional operation mode is sometimes lower than that in the steady operation mode.

The conventional internal-combustion ECU determines basic fuel injection amount based on intake pressure actually detected by intake pressure sensor 5. Therefore, the ECU decides that the amount of intaking air is decreased because the detected intake pressure is lowered under the transitional operation mode with the effect of inertia charge, and the fuel injection amount based on the detected intake pressure is decreased although the actual amount of intaking air is increased than that of steady state. As a result, sufficient amounts of fuel injection are not provided, and this has been posing problems such as air-fuel ratio (A/F ratio) fluctuations or feedback correction in the feedback control employing the $O_2$ sensor 10 significantly changes.

SUMMARY OF THE INVENTION

Accordingly, it is an object of the present invention to provide an internal-combustion engine control system that corrects amount of the fuel injection according to a differential pressure between an intake pressure in a steady operation mode and a current intake pressure in a transitional operation mode, wherein the effect of the inertia charge is enhanced, so as to suppress a change in an air-fuel ratio or a change in a feedback correction in feedback control using an $O_2$ sensor.

To this end, according to one aspect of the present invention, there is provided an internal-combustion engine control system provided with: intake pressure detecting means for detecting an intake pressure in the internal-combustion engine; operating state detecting means for detecting an operating state of the internal-combustion engine; and controlling means for controlling the operation of the internal-combustion engine according to the operating state of the internal-combustion engine, wherein the controlling means corrects the fuel injection amount according to a differential pressure between an intake pressure in a steady operation mode of the internal-combustion engine and an intake pressure detected by the intake pressure detecting means.

In a preferred form, the controlling means makes a correction to increase the fuel injection amount if the intake pressure detected by the intake pressure detecting means becomes lower than the intake pressure in the steady operation mode.

In another preferred form, the controlling means does not make a correction of the fuel injection amount based on the differential pressure if the differential pressure stays within a predetermined range.

In yet another preferred form, the internal-combustion engine is equipped with a variable valve timing device, and the controlling means corrects the fuel injection amount according to the control amount of the variable valve timing device and the differential pressure.

The controlling means is equipped with an acceleration and deceleration correcting function for correcting the fuel injection amount during acceleration or deceleration of a vehicle, and inhibits a correction of the fuel injection amount according to the differential pressure during acceleration or deceleration or for a predetermined period of time after the vehicle starts acceleration or deceleration.

In a further preferred form, the controlling means is equipped with an acceleration and deceleration correcting function for correcting the fuel injection amount during acceleration or deceleration of a vehicle, and inhibits a correction of the fuel injection amount according to the differential pressure during acceleration or deceleration or while an acceleration or deceleration correction is being made.

In yet another preferred form, the controlling means gradually increases the correction of the fuel injection amount calculated based on the differential pressure to a value at which making a correction is not inhibited, when the inhibition of making a correction of the fuel injection amount according to the differential pressure is removed.

DESCRIPTION OF THE PREFERRED EMBODIMENTS

First Embodiment

The present invention is intended to correct an intake pressure to suppress a change and the like in air-fuel ratio caused by the effect of inertia charge in an internal-combustion engine. Accordingly, even though the present invention is basically more effectively applied to an internal-combustion engine equipped with a variable valve timing device and powered by utilizing the effect of inertia charge, the effect of inertia charge is also observed in an internal-combustion engine not equipped with a variable valve timing device.

In a first embodiment of the present invention, a description will be given of a case wherein the present invention is applied to an internal-combustion engine not provided with variable valve timing device.

Figure 1:
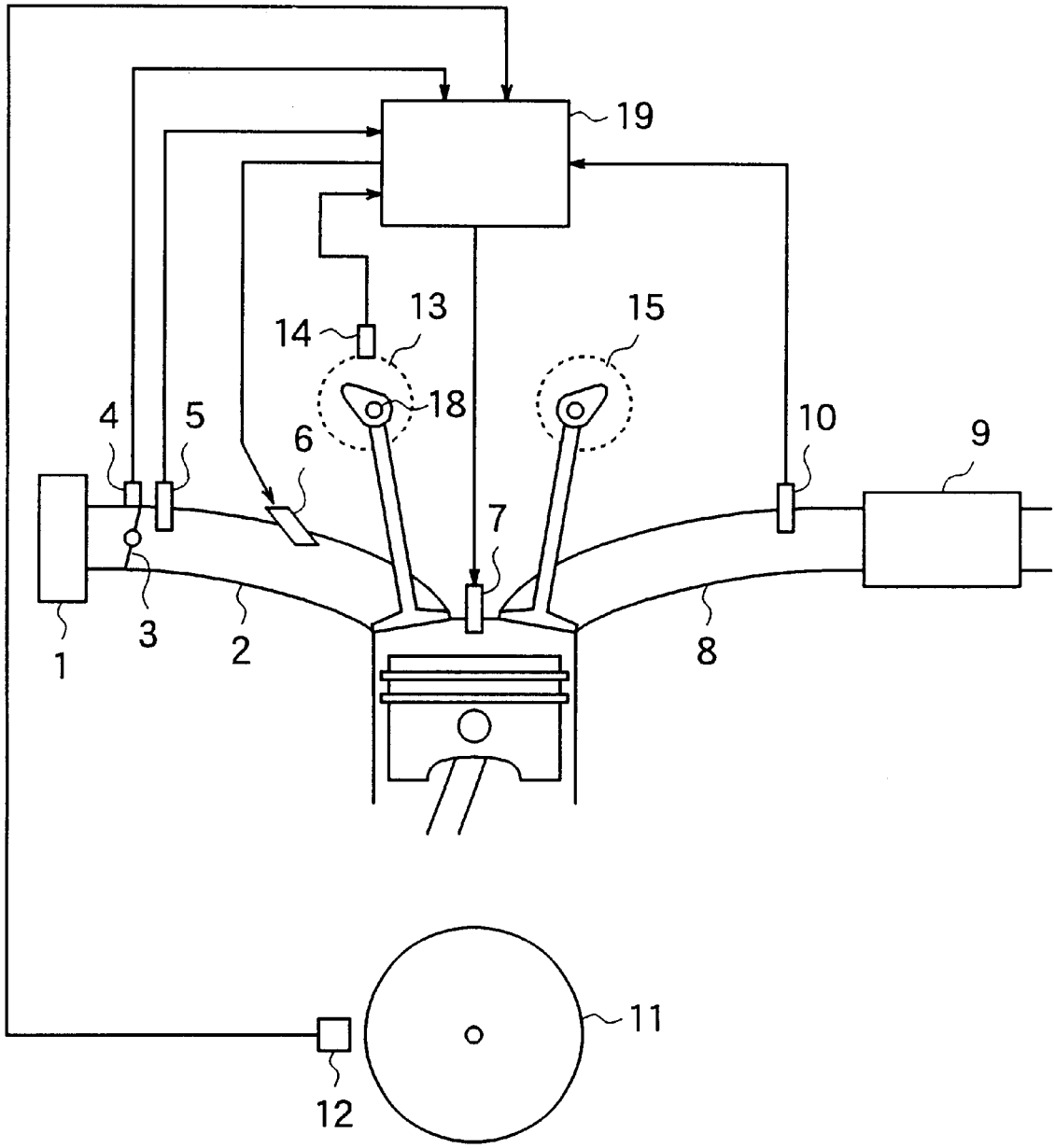
FIG. 1 shows a configuration internal-combustion engine control system in accordance with a first embodiment of the present invention.

FIG. 1 shows the composition of an internal-combustion engine control system according to the first embodiment of the present invention.

The internal-combustion engine shown in FIG. 1 is not equipped with a variable valve timing device, and a cam pulley 13 is fixed to a cam shaft 18. Parts similar to those of the conventional internal-combustion engine control system will be assigned reference numerals, and their description will not be repeated.

In addition to a two-dimensional map regarding fuel injection amounts, as in a conventional ECU, a ROM in an ECU 19 serving as a controlling means has a two-dimensional map in which intake pressures under a steady operation mode, which are determined by engine speed and throttle valve opening, have been stored.

Figure 2:
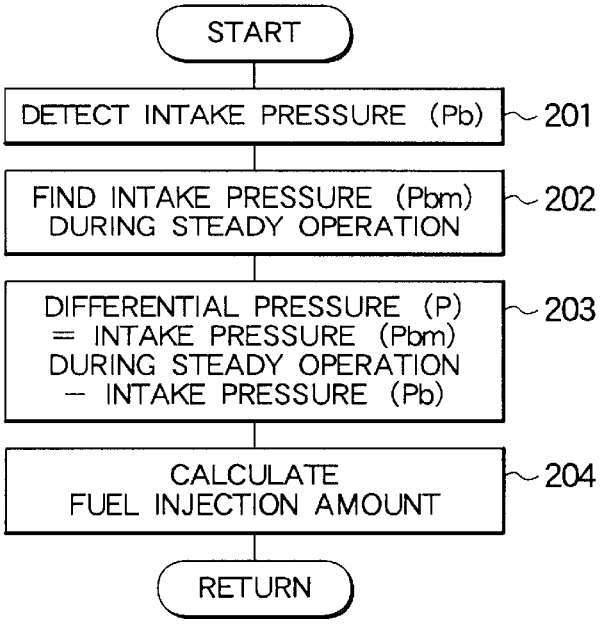
FIG. 2 is a flowchart illustrating details of the control processing of the internal-combustion engine control system in accordance with the first embodiment of the present invention.

FIG. 2 is a flowchart illustrating details of the control processing implemented by the of the internal-combustion engine control system in accordance with the first embodiment of the present invention.

As shown in FIG. 2, in step 201, an intake pressure Pb is detected by an intake pressure sensor 5 serving as an intake pressure detecting means. In step 202, an steady intake pressure Pbm in the steady operation mode stored in the two-dimensional map in the ROM is read out according to an engine speed and a throttle valve opening at the time when the intake pressure is detected by the intake pressure sensor 5. The throttle valve opening and the engine speed indicative of an operation mode of the internal-combustion engine are detected by a throttle valve opening sensor 4 and a crank angle sensor 12, respectively, which serve as an operation mode detecting means.

In step 203, a differential pressure P based on the steady intake pressure Pbm in the steady operation mode and the intake pressure Pb detected by the intake pressure sensor 5 is determined as follows:

$$P=Pbm-Pb \tag{1}$$

In step 204, an injector drive pulse width Ti corresponding to amount of the fuel injection is determined according to formula (2):

$$=\{Qpls\times(Pb+P)\times K\}\times Kinj+Tv \tag{2}$$

Where

Ti: Injector drive pulse width (msec)

Qpls: Coefficient for converting intake pressure into fuel injection amount (mcc/mmHg)

Pb: Detected intake pressure (mmHg)

K: Various correction coefficients

Kinj: Coefficient for converting discharge amount into pulse width (msec/mcc)

Tv: Invalid injection pulse width (msec)

A correction coefficient of a fuel injection amount stored in the two-dimensional map using engine speed and intake pressure as parameters is included in the foregoing various correction coefficients K. Such a correction is made by the ECU 19.

A basic fuel injection amount is determined by Qpls×Pb.

More specifically, according to formula (2), the basic fuel injection amount is corrected by the differential pressure P.

Thus, the injector drive pulse width Ti can be obtained by correcting the intake pressure by adding the differential pressure P, which is the differential between the steady intake pressure Pbm in the steady operation mode and the detected intake pressure Pb, to the intake pressure Pb in the transitional operation mode. Hence, for example, if the detected intake pressure Pb is lower than the steady intake pressure Pbm in the steady operation mode, then the injector pulse width Ti is increased. This makes it possible to secure an optimum fuel injection amount based on the increase in the intake air amount caused by the effect of inertia charge.

As a result, even if there is the differential pressure P mentioned above, a change in the air-fuel ratio A/F can be suppressed, and a change in the amount of the feedback correction made in the feedback control using an $O_2$ sensor 10 can be suppressed as well, thus enabling the occurrence of acceleration failure and the like to be controlled.

Figure 6:
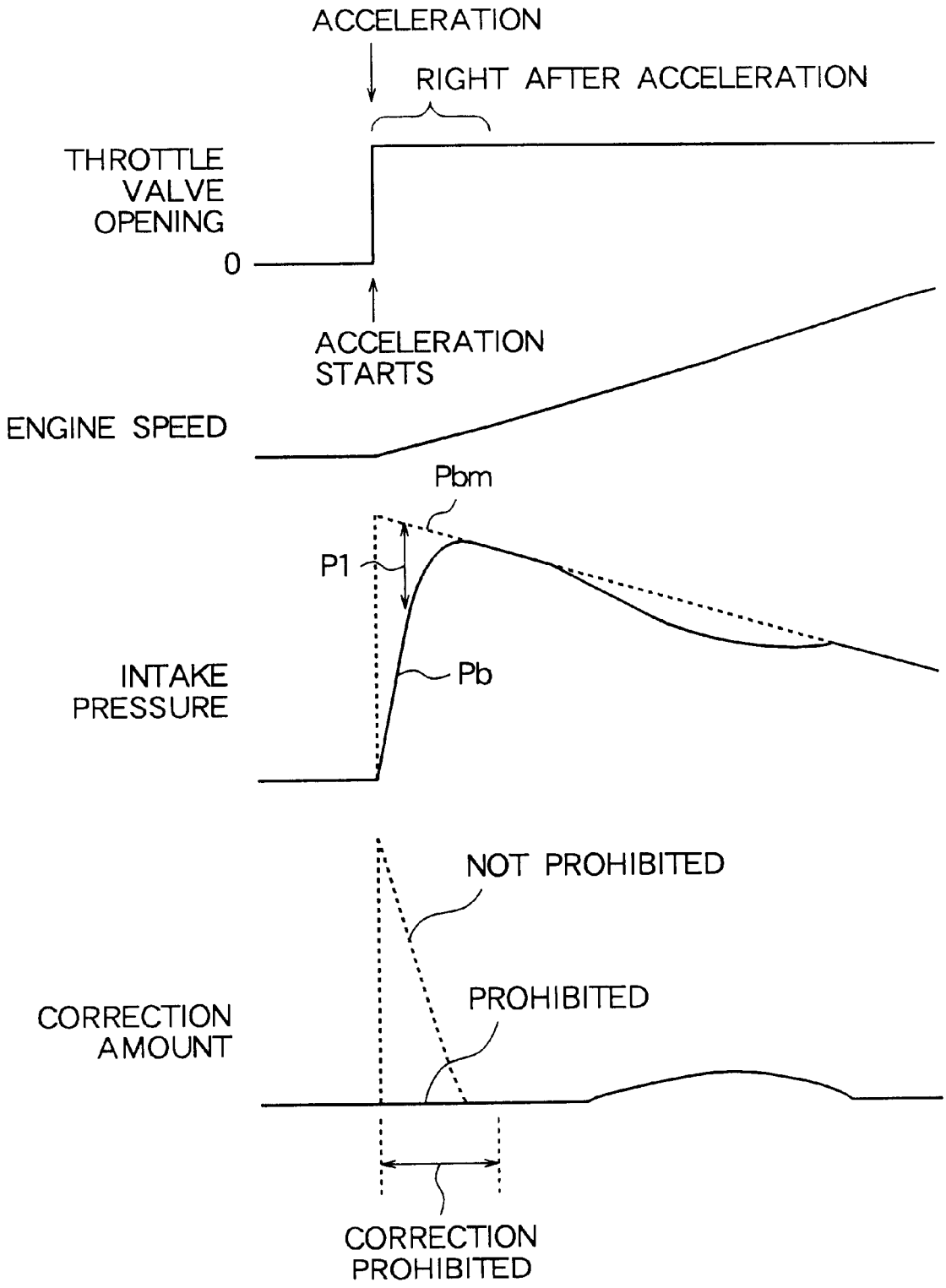
FIG. 6 is a chart illustrating characteristics of an operating state of the internal-combustion engine during acceleration.

For example, FIG. 6 shows a characteristic chart illustrating an operation state of the internal-combustion engine in the acceleration mode. In FIG. 6, after the throttle valve is opened, the actual intake pressure Pb slightly delays in changing, as indicated by the solid line, before it finally coincides with the steady intake pressure Pbm in the steady operation mode. Thereafter, the intake pressure Pb becomes lower than the steady intake pressure Pbm. This indicates that the intake pressure has decreased due to the effect of the inertia charge. In this state, although the intake pressure Pb has decreased as mentioned above, this is just seemingly so due to the effect of the inertia charge; actually, a great amount of intake air has been pushed into the internal-combustion engine.

In a conventional D-jetronic ECU determines a basic fuel injection amount simply on the basis of the actual intake pressure Pb. Hence, despite the fact that a great amount of intake air has actually been pushed into the internal-combustion engine, the basic fuel injection amount is decreased by an amount equivalent to the decrease in the intake pressure Pb as illustrated, thus resulting in an insufficient fuel.

According to the first embodiment of the present invention, however, an amount corresponding to the decrease caused by the effect of inertia charge is added to the actual intake pressure Pb to determine the fuel injection amount. Therefore, in the D-jetronic ECU, even if the intake pressure Pb decreases due to the effect of inertia charge, the fuel injection amount will not be decreased accordingly, so that a sufficient amount of fuel can be supplied to the internal-combustion engine.

Thus, according to the first embodiment of the present invention, if there is a differential pressure P, then the fuel injection amount is determined according to (Pb+P), i.e. (Pb+P)=(Pb+Pbm−Pb)=Pbm.

In other words, the first embodiment of the present invention is adapted to determine the basic fuel injection amount based on the steady intake pressure Pbm determined on the basis of the engine speed and the throttle valve opening under the inertia charge condition in the D-jetronic system that decides the basic fuel injection amount based on detected intake pressure Pb.

Figure 3:
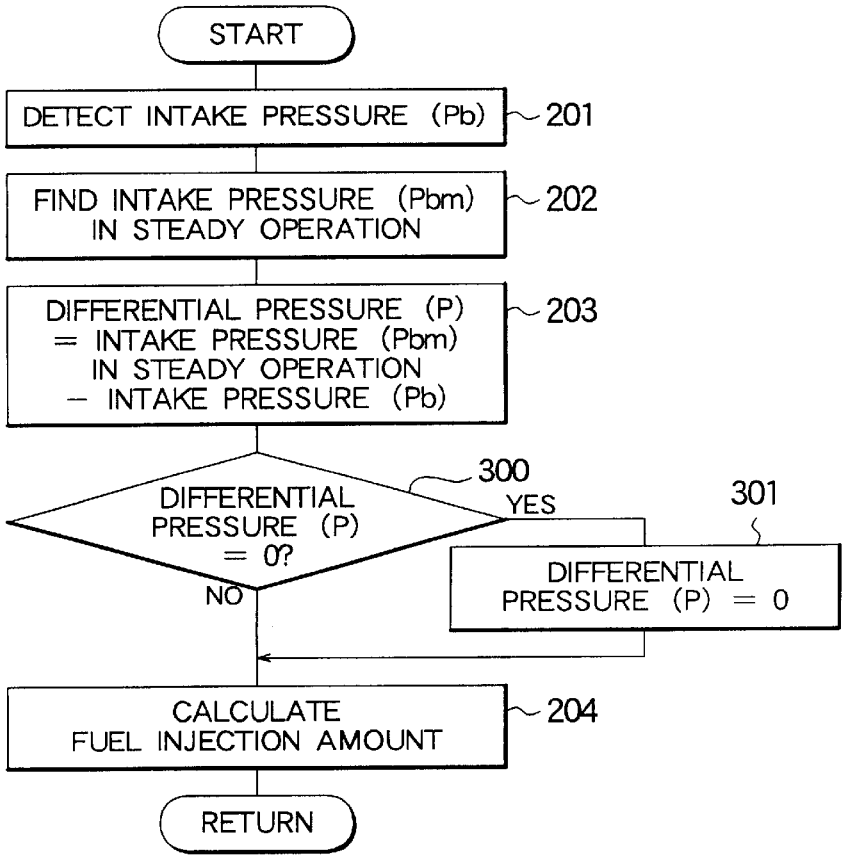
FIG. 3 is a flowchart illustrating an example of a modification of the control of the internal-combustion engine control system in accordance with the first embodiment of the present invention.

In the flowchart shown in FIG. 2, a correction is made whenever the differential pressure P is produced. Nevertheless, a determination whether the correction should be made or not may be made based on, for example, whether the differential pressure P is positive or negative. In FIG. 3, the contents of steps 201 to 204 are identical to those of steps marked with the same numerals, and the repeat description thereof will be omitted.

FIG. 3 shows a flowchart illustrating an example of a modification of the control implemented by the internal-combustion engine control system in accordance with the first embodiment of the present invention.

In step 300 following step 203 shown in FIG. 3, the ECU determines whether the differential pressure P is positive or negative. If the ECU determines that the differential pressure P is negative, the ECU advances to step 301 to set the differential pressure P to zero, and then advances to step 204.

As a result, if the differential pressure P is negative, that is, if the intake pressure Pb detected by the intake pressure sensor is higher than the steady intake pressure Pbm in the steady operation mode, no correction based on the differential pressure P is added to the fuel injection amount.

On the other hand, if the ECU determines in step 300 that the differential pressure P is positive, then it directly proceeds to step 204. As a result, the intake pressure is corrected only if the differential pressure P is positive, that is, only if the intake pressure Pb detected by the intake pressure sensor is lower than the steady intake pressure Pbm in the steady operation mode.

Generally speaking, a case wherein the differential pressure P is positive, i.e., the intake pressure Pb detected by the intake pressure sensor is lower than the steady intake pressure Pbm in the steady operation mode corresponds to the case wherein a vehicle is accelerating and a marked effect of inertia charge is observed.

Hence, more detailed operation control of the internal-combustion engine can be achieved by correcting the intake pressure based on whether the differential pressure P is positive or negative as discussed above.

In the first embodiment, the intake pressures Pbm in the steady operation mode that have been experimentally determined beforehand are stored in the ROM of the ECU 19 in the form of the two-dimensional map, and the data of the map is read out as necessary. The same advantage as discussed above can be obtained by determining the fuel injection amount by using the steady intake pressure Pbm in the steady operation mode when the vehicle is actually traveling, without preparing the above described two-dimensional map.

The present invention can be implemented in the same manner also by a method in which the steady intake pressure Pbm in the steady operation mode being experimentally prepared beforehand is stored in the form of a two-dimensional map in a ROM of the ECU 19, and the steady intake pressure Pbm obtained when a vehicle is traveling in the steady operation mode is learned and a correction value for correcting the two-dimensional map being prepared beforehand and stored in a RAM in the ECU 19, and based thereon, an injector drive pulse width Ti is calculated. In this case, more accurate control can be achieved.

In the first embodiment of the present invention, description has been made of the control of an internal-combustion engine that is not equipped with a variable valve timing device. However, the more conspicuous advantage can be obtained by applying the present invention to an internal-combustion engine equipped with a variable valve timing device.

Second Embodiment

In the first embodiment, the intake pressure is corrected whenever a difference was found between the steady intake pressure Pbm in the steady operation mode and the intake pressure Pb detected by the intake pressure sensor.

Nevertheless, since internal-combustion engines have intermittent intake strokes, there are times when the intake pressure pulsates. Therefore, if the intake pressure is always corrected even when the intake pressure pulsates, there is a danger in that the air-fuel ratio A/F will fluctuate.

Accordingly, in a second embodiment, a description will be made of control processing which can eliminate the influence of intake pressure pulsation.

Figure 4:
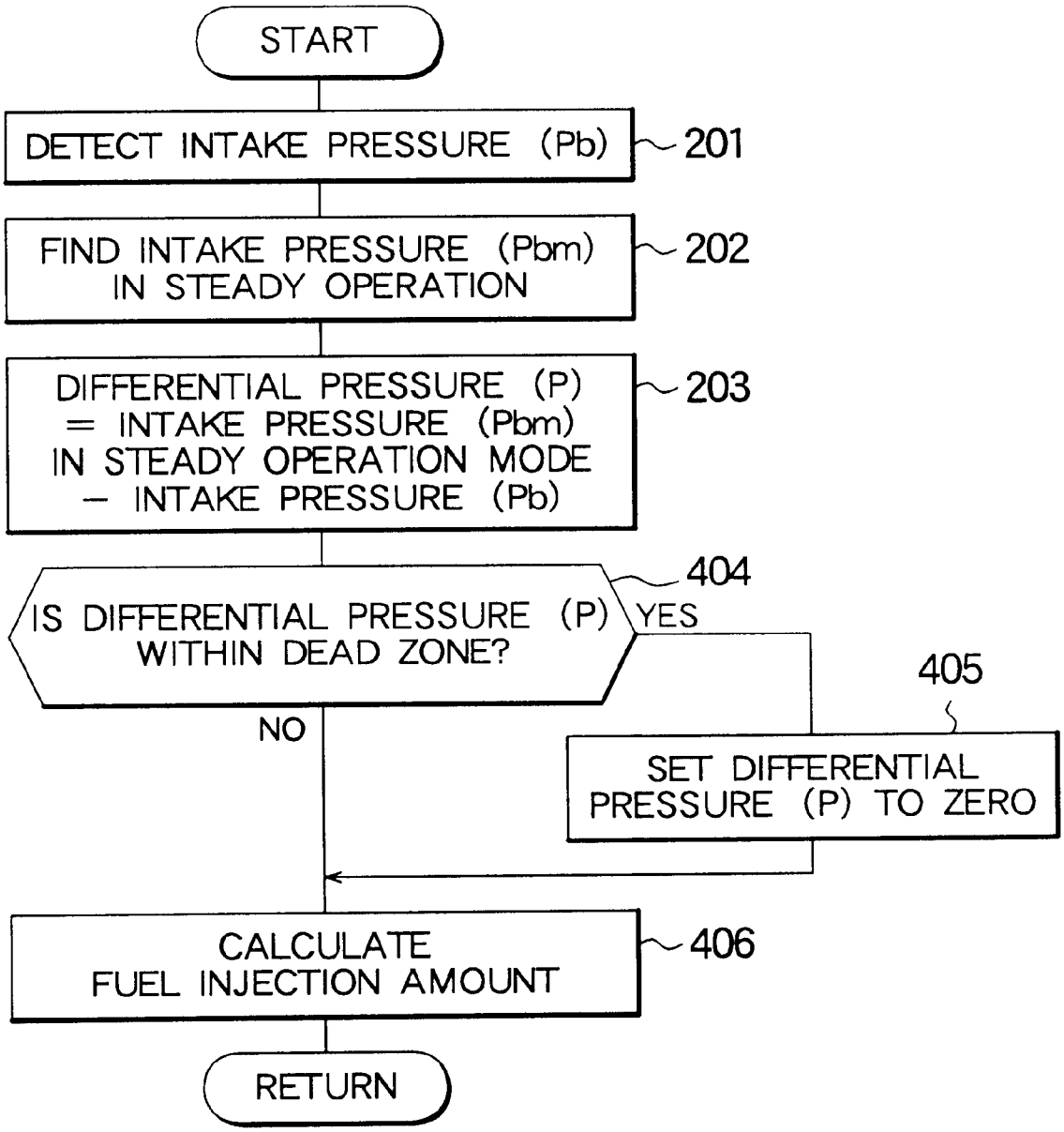
FIG. 4 is a flowchart illustrating details of the control of an internal-combustion engine control system in accordance with a second embodiment of the present invention.

FIG. 4 is a flowchart illustrating details of control implemented by an internal-combustion engine control system according to the second embodiment of the present invention. In FIG. 3, the contents of steps 201 to 203 are identical to those of steps marked with the same numerals, and the repeat description thereof will be omitted.

In step 404, following step 203, the ECU determines whether the differential pressure P which is the difference between the steady intake pressure Pbm in the steady operation mode and the intake pressure Pb detected by the intake pressure sensor 5 lies within a predetermined range, i.e., the range of a dead zone. The range of the dead zone is a range wherein changes in intake pressure are due to intake pulsation.

If the ECU determines that the differential pressure P lies within the range of the dead zone, then the ECU proceeds to step 405 wherein it sets the differential pressure P to zero. In the following step 406, the ECU does not correct the intake pressure; instead, it calculates the injector drive pulse width Ti according to formula (2) above.

On the other hand, if the ECU determines in step 404 that the differential pressure P does not lie within the range of the dead zone, then it determines that the amount of air introduced has increased due to the effect of inertia charge at the time of acceleration, and corrects the intake pressure according to the foregoing formula (2) and calculates the injector drive pulse width Ti in the following step 406. In this case, the detected intake pressure Pb is lower than the steady intake pressure Pbm in the steady operation mode, so that the injector pulse width Ti can be increased.

Thus, the internal-combustion engine control system according to the second embodiment of the present invention is capable of eliminating most changes in the intake pressure caused by intake pulsation. Hence, a change in the air-fuel ratio A/F can be suppressed with greater accuracy and a change in the amount of the feedback correction in the feedback control using the $O_2$ sensor 10 can be suppressed, as to inhibit the occurrence of acceleration failure and the like.

In the second embodiment of the present invention, description has been made of control of an internal-combustion engine, which is not equipped with a variable valve timing device. However, the more conspicuous advantage can be obtained by applying the present invention to an internal-combustion engine equipped with a variable valve timing device.

Third Embodiment

Figure 10:
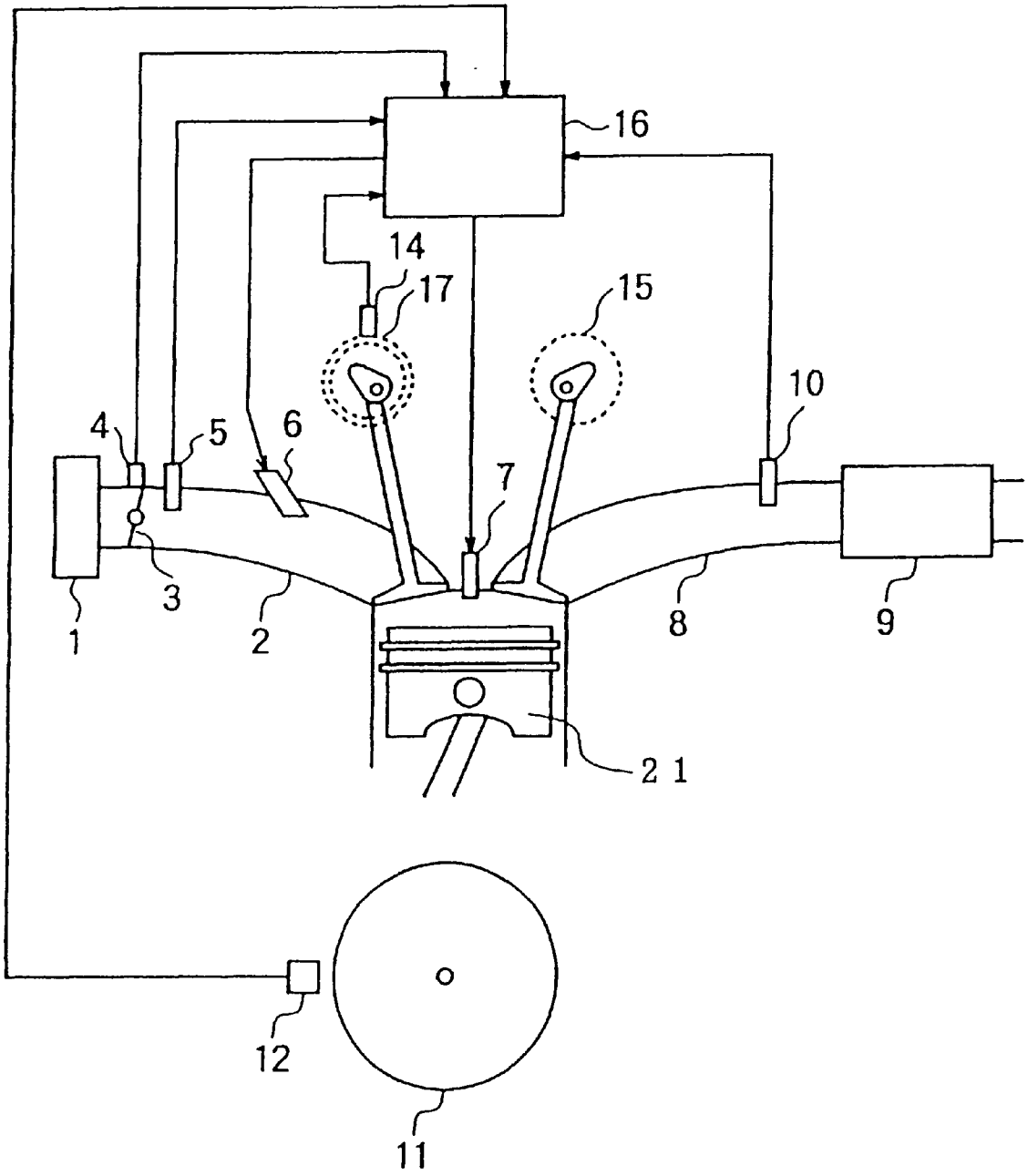
FIG. 10 is a schematic diagram showing the configuration of a conventional internal-combustion engine control system disclosed in Japanese Unexamined Patent Application laid-open No. 9-287496.

An internal-combustion engine in a third embodiment of the present invention is equipped with a variable valve timing device as in the conventional internal-combustion engine shown in FIG. 10.

The internal-combustion engine shown in FIG. 10 is equipped with the variable valve timing device only on the intake valve side. The present invention, however, can be applied in the same manner to an internal-combustion engine also provided with the variable valve timing device on the exhaust valve side.

The present invention can be applied irrespective of the mechanical configuration of the variable valve timing device.

Generally, in internal-combustion engines that are not equipped with a variable valve timing device, the valve timing has to be set at a value that provides the highest possible operating efficiency under limited operating states. On the other hand, an internal-combustion engine equipped with a variable valve timing device has a wider range of conditions under which it can be operated with high operating efficiency, and thus has a wider range of conditions under which the effect of inertia charge can be obtained. Therefore, the internal-combustion engine with the variable valve timing device receives greater effects from the correction of the intake pressure in calculating the fuel injection amount than is attainable with the internal-combustion engine with no variable valve timing device.

Figure 5:
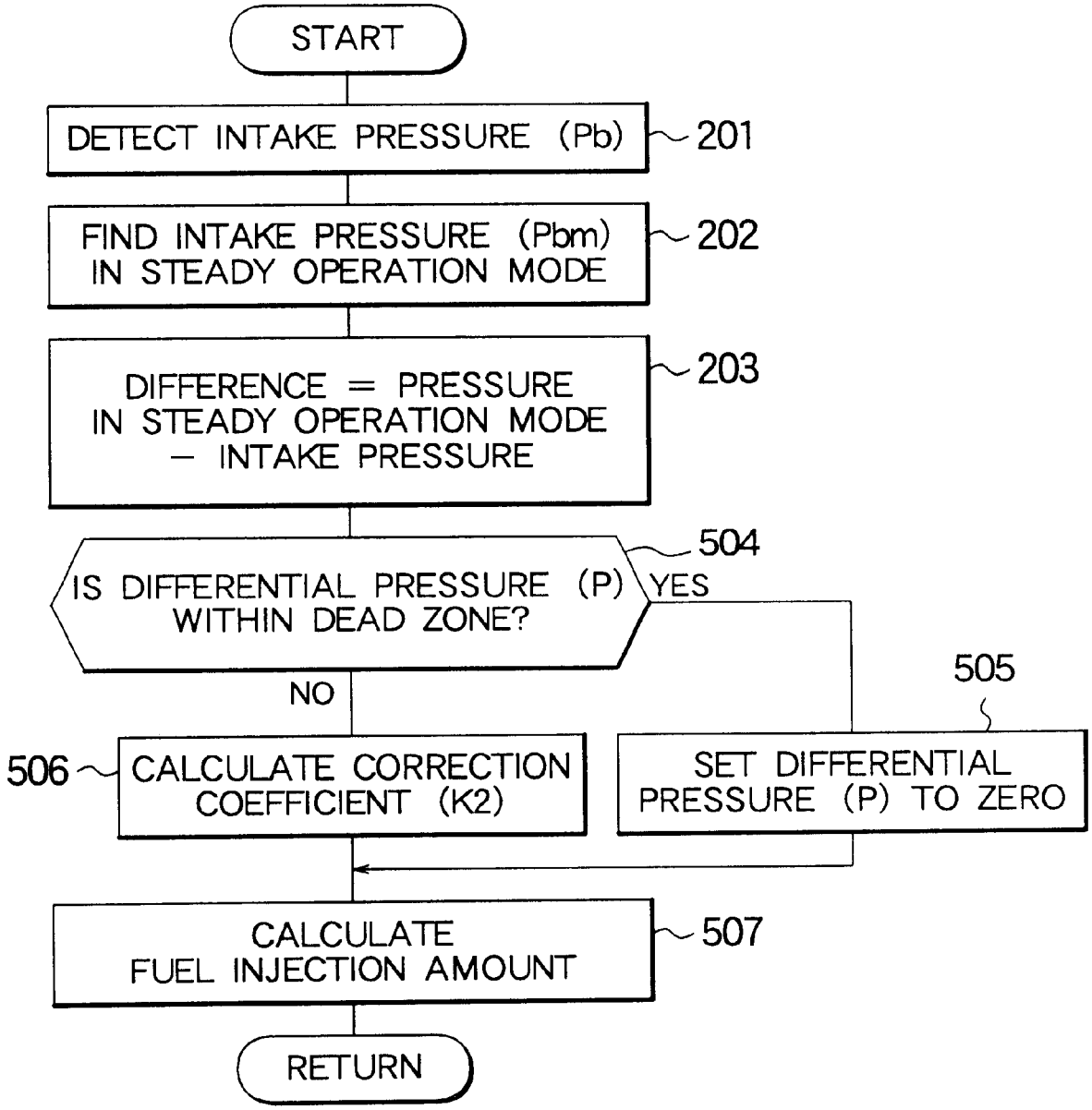
FIG. 5 is a flowchart illustrating the details of a control processing of an internal-combustion engine control system in accordance with a third embodiment of the present invention.

FIG. 5 is a flowchart illustrating details of control processing implemented by an internal-combustion engine control system in accordance with a third embodiment of the present invention. In FIG. 5, the contents of steps 201 to 203 are identical to those of steps marked with the same numerals, and the repeat description thereof will be omitted.

As shown in FIG. 5, in step 504, if the ECU determines that the differential pressure P lies out of the range of the dead zone, then it calculates a correction coefficient K2, which is expressed by formula (3) shown below, in step 506.

$$K2=f(VT,P) \tag{3}$$

Where VT indicates a valve timing (degCA) of the variable valve timing device; it indicates an advance that provides a reference obtained when valve overlap between an intake valve and an exhaust valve is minimum.

As indicated by formula (3), the correction coefficient K2 is calculated according to the valve timing VT of the variable valve timing device and the differential pressure P by referring to the data set in the ROM of the ECU 19 beforehand.

The correction coefficient K2 is set so that it increases as the valve timing VT advances as the differential pressure P increases.

In the above description, the actual valve timing is used as the valve timing VT. The actual valve timing is calculated by the ECU 19 on the basis of outputs of the crank angle sensor 12 and the cam angle sensor 14 functioning as the valve timing detecting means.

As the value of the valve timing VT in the control processing described above, a control amount (a target advance amount) of the variable valve timing device may alternatively be used to implement the present invention in the same manner as in a case where the actual valve timing is used.

In step 507, an injector drive pulse width Ti is determined using the correction coefficient K2.

$$=(Qpls\times Pb\times K\times K2)\times Kinj+Tv \tag{4}$$

As can be seen from formula (3) and formula (4), the third embodiment of the present invention does not merely correct the intake pressure according to the differential pressure P it corrects the correction coefficient K2 according to the differential pressure P and the valve timing VT, and employs the corrected correction coefficient K2 to calculate the injector drive pulse width Ti.

This correction allows the injector pulse width Ti to be increased if, for example, a detected intake pressure Pb drops below the steady intake pressure Pbm in the steady operation mode.

Thus, according to the third embodiment of the present invention, it is possible to suppress a change in the air-fuel ratio A/F caused by an increase in the amount of intake air due to the effect of inertia charge or a change in the amount of feedback correction made in the feedback control using the $O_2$ sensor 10 by calculating the injector drive pulse width Ti using the correction coefficient K2 calculated based on the differential pressure P and the valve timing VT.

The same advantage obtained in the third embodiment by determining the correction coefficient K2 according to the valve timing VT and the differential pressure P can also be achieved in the first and second embodiments by calculating the correction coefficient K2 according to the differential pressure P with fixing the valve timing VT and by calculating the injector drive pulse width Ti using the calculated correction coefficient K2.

Fourth Embodiment

It is a matter of course that an intake pressure Pb detected by an intake pressure sensor 5 changes if the throttle valve opening is changed during acceleration or deceleration, resulting in a change in the air-fuel ratio A/F. To suppress a change in the air-fuel ratio A/F during acceleration or deceleration, the air-fuel ratio A/F is usually corrected during the acceleration or deceleration. This is known as acceleration or deceleration correction.

Hence, correcting the intake pressure discussed above while an acceleration or deceleration correction is being made may cause a significant change in the air-fuel ratio A/F.

A fourth embodiment of the present invention relates to a control processing designed so that a correction based on the differential pressure P is not made during an acceleration or deceleration correction.

FIG. 6 shows characteristic curves indicative of the operating states of an internal-combustion engine at the time of acceleration.

As shown in FIG. 6, an intake pressure Pb (indicated by a solid line) develops a delay in the change of the actual intake pressure with respect to an intake pressure Pbm (indicated by a dotted line) in the steady operation mode which corresponds to actual engine speed and throttle valve opening, immediately following the start of acceleration. The delay in the pressure change leads to a differential pressure P1 between the steady intake pressure Pbm in the steady operation mode and the actual intake pressure Pb detected by the intake pressure sensor 5. The differential pressure P1 is generated by the delay of intaking from opening operation of the throttle valve, thus the differential pressure P1 differs from the differential pressure P generated by the effect of inertia charge.

Hence, under such a condition, control should not be conducted in an attempt to correct an error attributable to the effect of inertia charge. For instance, if a correction of the aforesaid embodiment is made under the condition, then a large correction amount is given immediately following acceleration as shown in FIG. 6. However, since the differential pressure P1 is not attributable to the effect of inertia charge, the entire correction amount will turn into an error.

For this reason, the fourth embodiment is adapted not to add a correction to the differential pressure P1.

Figure 7:
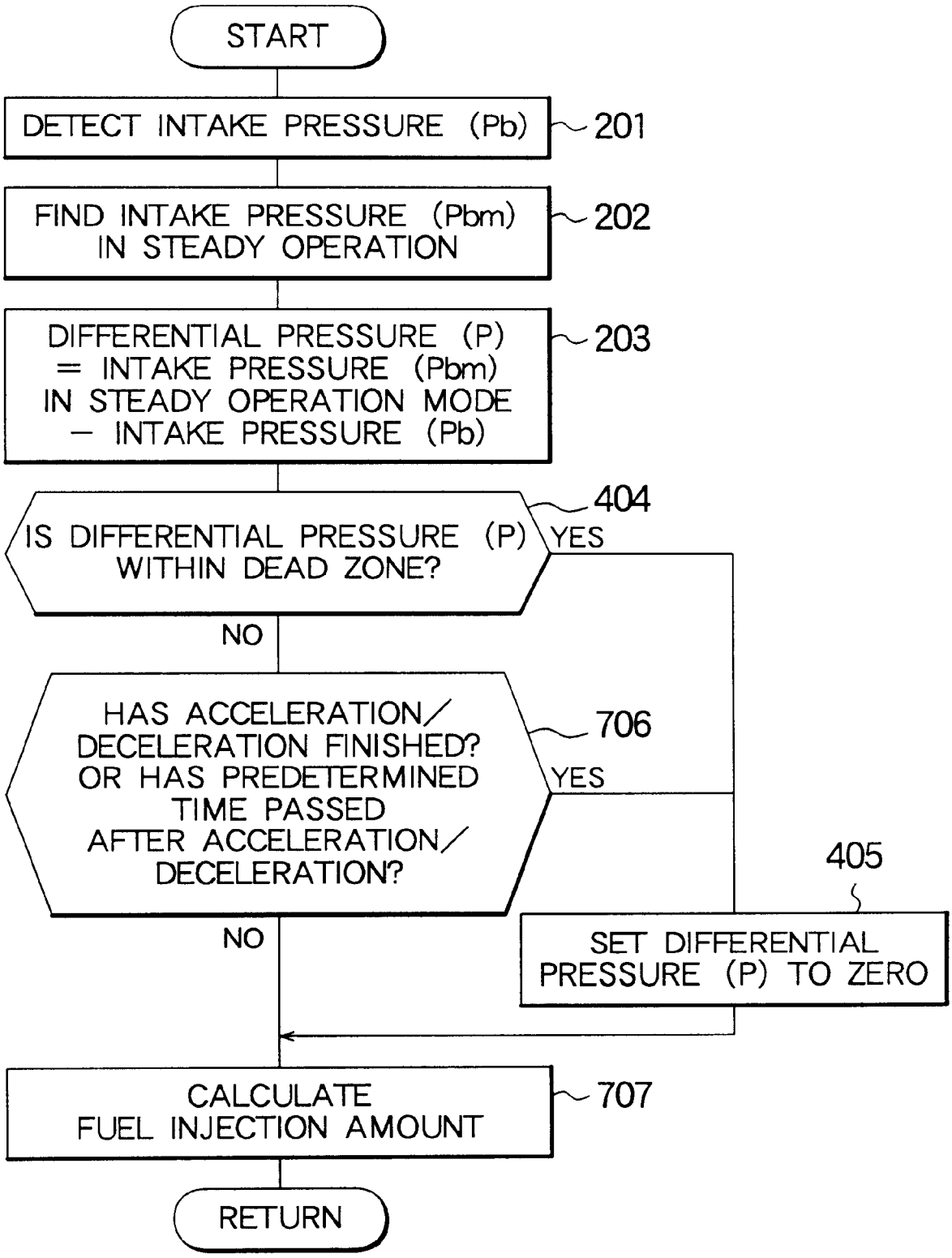
FIG. 7 is a flowchart illustrating details of control of an internal-combustion engine control system in accordance with a fourth embodiment of the present invention.

FIG. 7 is a flowchart illustrating details of control carried out by an internal-combustion engine control system in accordance with the fourth embodiment of the present invention.

Step 201 to step 203 and step 404 and step 405 are the same as the corresponding steps shown in FIG. 4. Hence, discussion of these steps will not be repeated herein.

In step 404, if the ECU determines that the differential pressure P lies out of a predetermined range, it advances to step 706.

In step 706, the ECU determines whether a vehicle has performed acceleration or deceleration, according to, for example, a detection signal from a throttle valve opening sensor 4.

If the ECU determines in step 706 that the vehicle is accelerating or decelerating, or if it determines that a predetermined time has not yet passed after the acceleration or deceleration was carried out, it proceeds to step 405 where it sets the differential pressure P to zero to prevent a correction of the intake pressure according to the differential pressure P.

After the correction is prevented, the ECU proceeds to step 707 where it makes an acceleration or deceleration correction including the term K of formula (2). Consequently, the change caused by the acceleration or deceleration can be corrected so as to enable a change in the air-fuel ratio A/F to be suppressed.

On the other hand, if the ECU determines in step 706 that no acceleration or deceleration is being performed, or if it determines that the predetermined time has passed since acceleration or deceleration was carried out, then it determines that the differential pressure P has been produced due to the effect of the inertia charge and advances to step 707. In step 707, the ECU calculates the injector drive pulse width Ti using the intake pressure that has been corrected by the differential pressure P according to formula (2) above. For example, if the detected intake pressure Pb drops lower than the steady intake pressure Pbm in the steady operation mode, the injector pulse width Ti can be increased.

Thus, the correction of the intake pressure based on the differential pressure P is not made while the vehicle is accelerating or decelerating, or until a predetermined time passes after acceleration or deceleration has been performed. This makes it possible to suppress a change in the air-fuel ratio A/F or a change in the amount of the feedback correction made in the feedback control using an $O_2$ sensor 10.

In the above embodiment, a correction of the intake pressure on the basis of the aforesaid differential pressure P is not made during the acceleration or deceleration mode or until a predetermined time passes after completion of the accelerating or decelerating operation. Alternatively, however, the foregoing correction of the intake pressure on the basis of the aforesaid differential pressure P is not made during the acceleration or deceleration mode or until a predetermined period passes (or time, the number of ignitions, the integrated value of the number of revolutions, etc. is reached) after completion of the accelerating or decelerating operation, or until a predetermined period passes after the accelerating or decelerating operation is begun.

The more conspicuous advantage can be obtained by applying the control process in accordance with the fourth embodiment to an internal-combustion engine equipped with a variable valve timing device.

Fifth Embodiment

Figure 8:
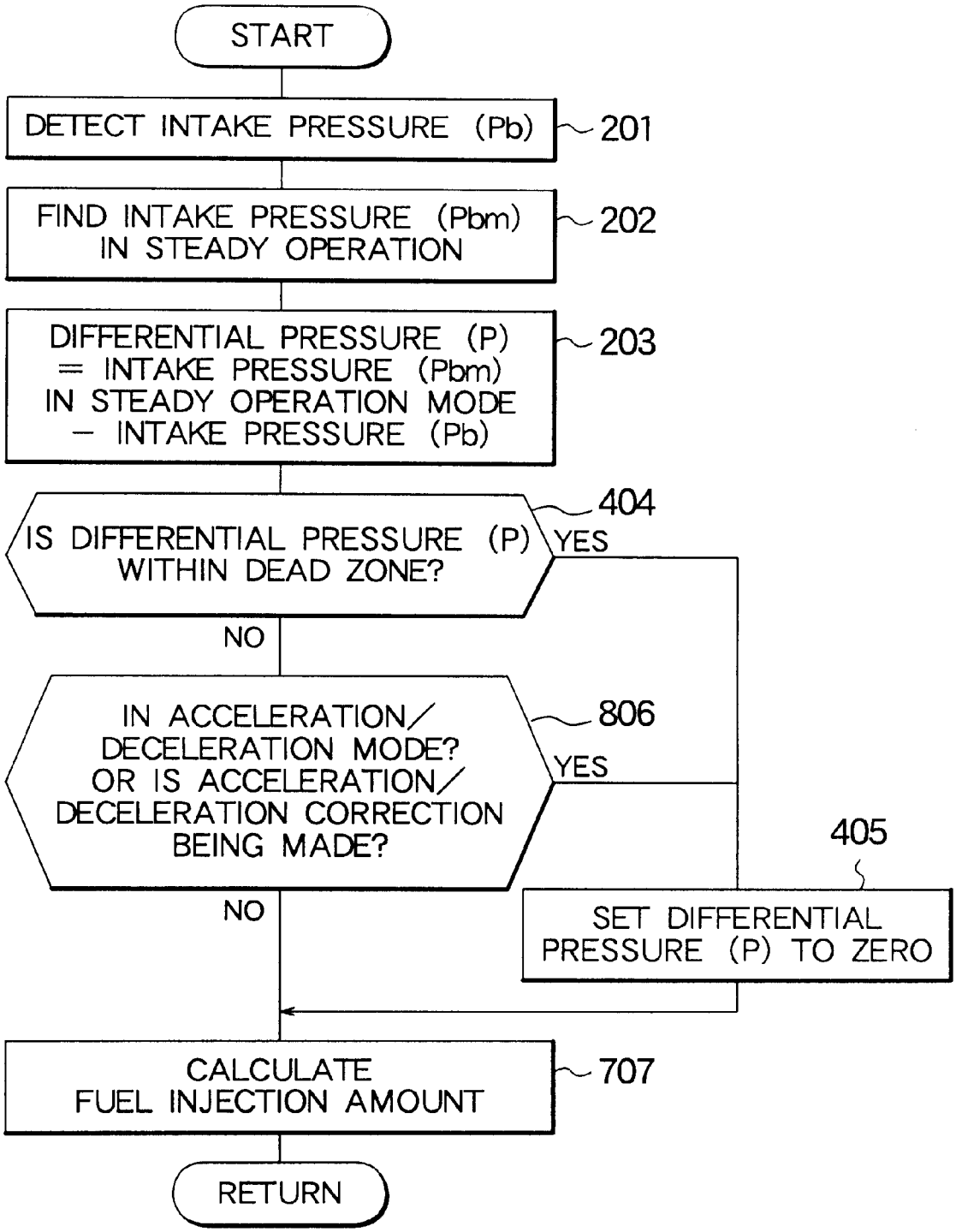
FIG. 8 is a flowchart illustrating details of control of an internal-combustion engine control system in accordance with a fifth embodiment of the present invention.

FIG. 8 is a flowchart illustrating details of control carried out by an internal-combustion engine control system in accordance with a fifth embodiment of the present invention. The steps shown in FIG. 8 are identical to the corresponding steps of the fourth embodiment, except that step 706 in FIG. 7 has been replaced by step 806. Step 806 shown in FIG. 8 is a step wherein the ECU sets the differential pressure P to zero to prevent a correction during acceleration or deceleration or while acceleration or deceleration correction is being made.

More specifically, if the ECU determines in step 806 that a vehicle is accelerating or decelerating or making an acceleration or deceleration correction, it advances to step 405 wherein it sets the differential pressure P to zero.

On the other hand, if the ECU determines in step 806 that the vehicle is not accelerating or decelerating or not making an acceleration or deceleration correction, then it advances to step 707 wherein it calculates amount of the fuel injection using a correction based on the differential pressure P. For example, if a detected intake pressure Pb drops below an intake pressure Pbm in a steady operation mode, then an injector pulse width Ti can be increased.

Thus, the fifth embodiment in accordance with the present invention can provide the same advantage as that provided by the fourth embodiment because it sets the differential pressure P to zero to inhibit a correction during acceleration or deceleration or while an acceleration or deceleration correction is being made.

The more conspicuous advantage can be obtained by applying the control in accordance with the fifth embodiment to an internal-combustion engine equipped with a variable valve timing device.

Sixth Embodiment

Figure 9:
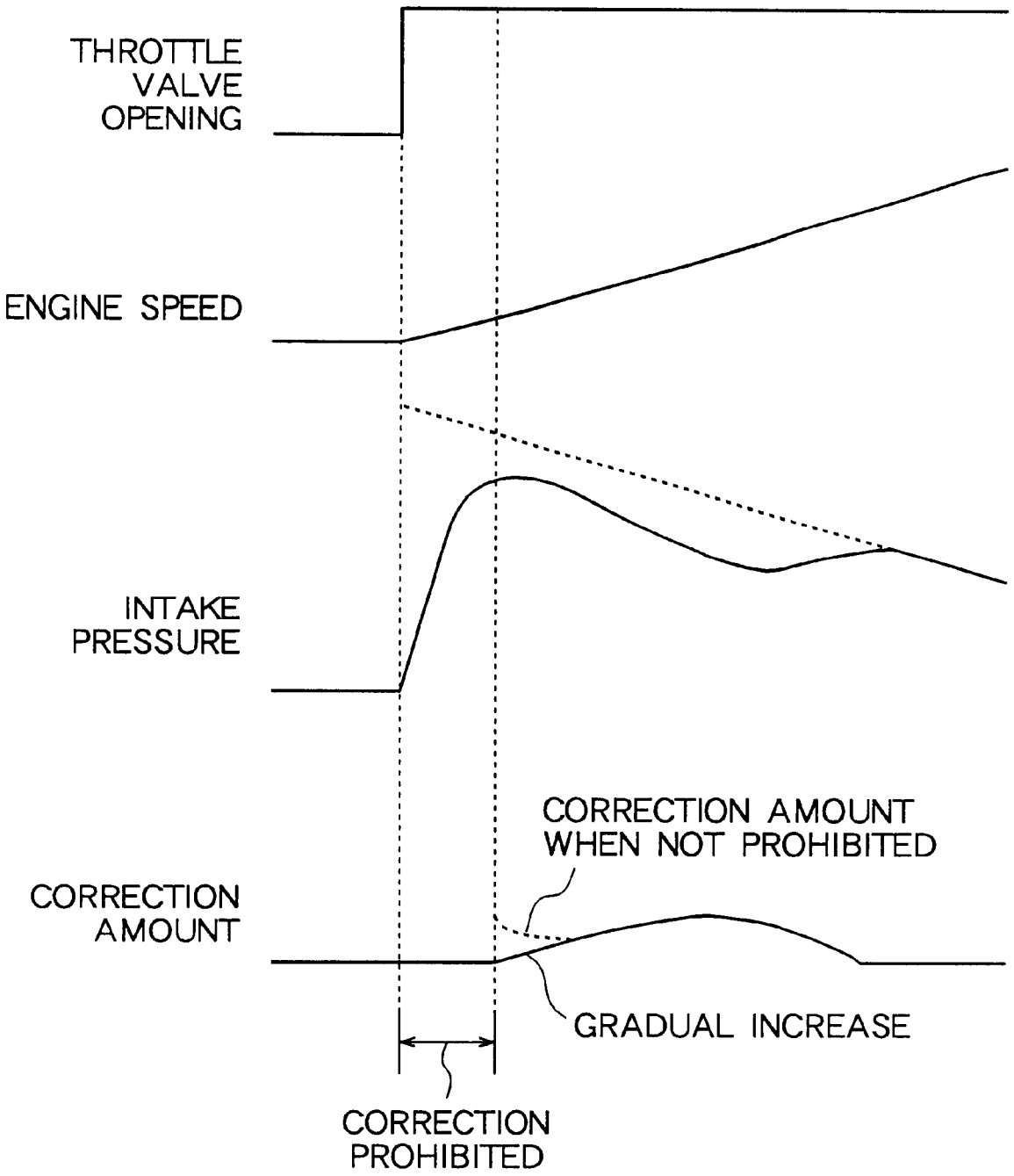
FIG. 9 is a chart illustrating characteristics observed when the control by an internal-combustion engine control system in accordance with a sixth embodiment of the present invention is carried out.

FIG. 9 shows a chart illustrating characteristics observed when control by an internal-combustion engine control system in accordance with a sixth embodiment of the present invention is carried out.

The sixth embodiment relates to control processing for restarting the correction of amount of the fuel injection that has been inhibited in the fourth and fifth embodiments.

To be more specific, as shown by the characteristic curves indicated by solid lines in FIG. 9, when the foregoing inhibition against making a correction is removed, an injector drive pulse width Ti is calculated while gradually increasing the value of a differential pressure P, which has been set to zero, to a value at which making a correction is not inhibited.

Performing such control processing makes it possible to converge gradually, continuously, or in steps, a correction amount of the fuel injection amount based on the differential pressure P, which has set to zero by the inhibition of making a correction, to a correction amount (hereinafter referred to as a "normal value") in a case free of the inhibition of making a correction.

An example illustrated in FIG. 9 shows a case, wherein a correction amount is increased to a normal value, as a case for converging the correction amount to the normal value. If the current intake pressure is higher than the steady intake pressure Pbm, then the correction amount will be a negative value; hence, the correction amount is decreased to the normal value in this case.

Thus, according to the sixth embodiment, the differential pressure P, which has been set to zero, is gradually increased to its original value, i.e., the value at which making a correction is not inhibited, immediately after the above correction inhibition is removed. Therefore, since the correction of the fuel injection amount based on the differential pressure P is not made abruptly, a sudden change in the air-fuel ratio A/F, as well as, and a sudden change in the amount of feedback correction made in feedback control employing an $O_2$ sensor 10 can be suppressed.

Thus, the of the internal-combustion engine control system in accordance with the present invention is provided with: intake pressure detecting means for detecting an intake pressure in the internal-combustion engine; operating state detecting means for detecting an operating state of the internal-combustion engine; and controlling means for controlling the operation of the internal-combustion engine according to the operating state of the internal-combustion engine, wherein the controlling means corrects the fuel injection amount according to a differential pressure between an intake pressure in a steady operation mode of the internal-combustion engine and an intake pressure detected by the intake pressure detecting means. Therefore, it is possible to suppress a change in the air-fuel ratio due to the effect of the inertia charge, or a change in the amount of a feedback correction made in the feedback control using the $O_2$ sensor, and it is also possible to control the occurrence of a failure such as an acceleration failure attributable to a change in an intake pressure.

Further, the controlling means makes a correction to increase the fuel injection amount if the intake pressure detected by the intake pressure detecting means has become lower than the intake pressure in the steady operation mode. Therefore, it is possible to suppress a change in an air-fuel ratio due to the effect of inertia charge, or a change in the amount of a feedback correction made in the feedback control using the $O_2$ sensor, and it is also possible to control the occurrence of a failure such as an acceleration failure attributable to a change in an intake pressure.

Furthermore, the controlling means does not make a correction of the fuel injection amount based on the differential pressure if the differential pressure stays within a predetermined range. This makes it possible to substantially eliminate corrections in response to changes in intake pressure caused by intake pulsation. Hence, a change in the air-fuel ratio can be suppressed with higher accuracy, and a change in the amount of the feedback correction made in the feedback control using the $O_2$ sensor can be suppressed, enabling the occurrence of an acceleration failure and the like to be controlled.

Moreover, the control system of an internal-combustion engine according to claim 1, further comprising an acceleration and deceleration correcting means for correcting the fuel injection amount during an acceleration or deceleration mode of the internal-combustion engine, wherein making a correction of the fuel injection amount based on the differential pressure is inhibited during the accelerating or decelerating mode of the internal-combustion engine, or for a predetermined period of time after acceleration or deceleration is started, or while an acceleration or deceleration correction is being made by the acceleration and deceleration correcting means. Therefore, it is possible to eliminate the correction for the change in intake pressure caused by pulsation of intaking air, and thus suppressing a change in an air-fuel ratio with high accuracy, and it is also possible to suppress a change in the amount of a feedback correction made in the feedback control using the $O_2$ sensor, thus suppressing the occurrence of a failure such as an acceleration.

In addition, the controlling means gradually converges a correction amount computed on the basis of a differential pressure to a normal value when releasing the inhibition of making a correction of the fuel injection amount based on the differential pressure. Therefore, a vehicle can be maintained in a good operating condition when the inhibition of making a correction of the fuel injection amount based on the differential pressure is cleared.

Further, the variable valve timing device is further provided to change the valve timing on the intake side or the exhaust side of the internal-combustion engine, and the controlling means corrects the fuel injection amount based on the valve timing and the differential pressure. This arrangement makes it possible to restrain changes in the air-fuel ratio caused by the effect of inertia charge or changes in the feedback correction amount given by the feedback control using the $O_2$ sensor, and also to minimize chances of failures such as acceleration failures caused by changes in intake pressure in an internal-combustion engine equipped with a variable valve timing device.

Furthermore, the controlling means employs the control amount of the variable valve timing device as the valve timing used for correcting the fuel injection amount. This arrangement makes it possible to restrain changes in the air-fuel ratio caused by the effect of inertia charge or changes in the feedback correction amount given by the feedback control using the $O_2$ sensor, and also to minimize chances of failures such as acceleration failures caused by changes in intake pressure in an internal-combustion engine equipped with a variable valve timing device.

In addition, the valve timing detecting means for detecting the valve timing is further provided, and an output of the valve timing detecting means is employed as the valve timing used for correcting the fuel injection amount. This arrangement makes it possible to restrain changes in the air-fuel ratio caused by the effect of inertia charge or changes in the feedback correction amount given by the feedback control using the $O_2$ sensor, and also to minimize chances of failures such as acceleration failures caused by changes in intake pressure in an internal-combustion engine equipped with a variable valve timing device.

Further, the correction amount is set so that it is increased as the valve timing advances, thus permitting an appropriate amount of fuel to be supplied according to the valve timing.

What is claimed is:

1. An internal-combustion engine control system, comprising:

intake pressure detecting means for detecting an intake pressure in the internal-combustion engine;

operating state detecting means for detecting an operating state of the internal-combustion engine; and controlling means for controlling the operation of the internal-combustion engine according to the operating state of the internal-combustion engine;

wherein the controlling means corrects amount of the fuel injection according to a differential pressure between an intake pressure in a steady operation mode of the internal-combustion engine and an intake pressure detected by the intake pressure detecting means.

2. An internal-combustion engine control system according to claim 1, wherein the controlling means increases the fuel injection amount if the intake pressure detected by the intake pressure detecting means has become lower than the intake pressure in the steady operation mode.

3. An internal-combustion engine control system according to claim 1, wherein the controlling means inhibits a correction of the fuel injection amount, which is based on the differential pressure, if the differential pressure stays within a predetermined range.

4. A control system of an internal-combustion engine according to claim 1, further comprising an acceleration and deceleration correcting means for correcting the fuel injection amount during an acceleration or deceleration mode of the internal-combustion engine, wherein making a correction of the fuel injection amount based on the differential pressure is inhibited during the accelerating or decelerating mode of the internal-combustion engine, or for a predetermined period of time after acceleration or deceleration is started, or while an acceleration or deceleration correction is being made by the acceleration and deceleration correcting means.

5. A control system of an internal-combustion engine according to claim 4, wherein the controlling means gradually converges a correction amount calculated on the basis of the differential pressure to a normal value when it clears the inhibition of making a correction of the fuel injection amount based on the differential pressure.

6. A control system of an internal-combustion engine according to claim 1, further comprising a variable valve timing device for changing a valve timing at an inlet side or an exhaust side of the internal-combustion engine, wherein the controlling means corrects the fuel injection amount based on the valve timing and the differential pressure.

7. A control system of an internal-combustion engine according to claim 6, wherein the controlling means uses a control amount of the variable valve timing device as a valve timing used for correcting the fuel injection amount.

8. A control system of an internal-combustion engine according to claim 6, further comprising a valve timing detecting means for detecting the valve timing, wherein an output of the valve timing detecting means is used as a valve timing used for correcting the fuel injection amount.

9. A control system of an internal-combustion engine according to claim 6, wherein the correction amount is set to a larger value as the valve timing advances.

10. A control system of an internal-combustion engine according to claim 6, wherein the correction amount is set to a larger value as the differential pressure increases.

* * * * *